US008326208B2

(12) United States Patent
Tamura et al.

(10) Patent No.: US 8,326,208 B2
(45) Date of Patent: Dec. 4, 2012

(54) PAPER DISCHARGE DEVICE AND IMAGE FORMING APPARATUS

(75) Inventors: Osamu Tamura, Ebina (JP); Yoshiyuki Takaishi, Ebina (JP); Ryuichi Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 904 days.

(21) Appl. No.: 12/057,659

(22) Filed: Mar. 28, 2008

(65) Prior Publication Data

US 2009/0087240 A1 Apr. 2, 2009

(30) Foreign Application Priority Data

Sep. 28, 2007 (JP) ..... 2007-253852

(51) Int. Cl.
*G03G 15/00* (2006.01)

(52) U.S. Cl. ..... 399/405; 399/407; 271/213; 271/214; 271/221

(58) Field of Classification Search ..... 399/405, 399/407; 271/292, 221, 205, 207, 288, 214, 271/213

See application file for complete search history.

(56) References Cited

U.S. PATENT DOCUMENTS

| | | | | |
|---|---|---|---|---|
| 4,856,768 | A | 8/1989 | Hiroki et al. | |
| 5,374,051 | A * | 12/1994 | Ulrich et al. | 271/222 |
| 6,231,039 | B1 * | 5/2001 | Chung | 270/58.01 |
| 6,293,543 | B1 * | 9/2001 | Lawrence | 271/213 |
| 7,300,052 | B2 * | 11/2007 | Tamura et al. | 271/221 |
| 2003/0016402 | A1 | 1/2003 | Saito | |

FOREIGN PATENT DOCUMENTS

| | | | |
|---|---|---|---|
| JP | 61-033464 | A | 2/1986 |
| JP | 62-290670 | A | 12/1987 |
| JP | 04-209158 | A | 7/1992 |
| JP | 11-342937 | A | 12/1999 |
| JP | 2003-20158 | A | 1/2003 |
| JP | 2003-312930 | A | 11/2003 |
| JP | 2003-312931 | A | 11/2003 |
| JP | 2003312931 | A * | 11/2003 |
| JP | 2004-284792 | A | 10/2004 |
| JP | 2006-137529 | A | 6/2006 |
| JP | 2006-137530 | A | 6/2006 |

OTHER PUBLICATIONS

English machine translation of JP2003312931.*
English machine translation of JP2003312931, Nov. 2003.*
Japanese Office Action issued in Application No. 2007-253852, dated Feb. 9, 2010.

* cited by examiner

*Primary Examiner* — Matthew G Marini
(74) *Attorney, Agent, or Firm* — Sughrue Mion, PLLC

(57) ABSTRACT

A paper discharge device includes a discharge member, a paper carry portion, a first moving section, a pair of paper side end register sections, a second moving section, and a discharge paper control section. The paper carry portion carries thereon paper discharged by the discharge member. The first moving section moves the discharge member in a paper width direction to shift the position of paper. The pair of paper side end register sections holds the paper from both sides in the paper width direction. The second moving section moves the pair of paper side end register sections in the paper width direction. The discharge paper control section, when the shifting direction of the paper by the first moving section is switched from one direction to the other direction, controls the second moving section to move the pair of paper side end register section in the other direction.

15 Claims, 11 Drawing Sheets

PAPER DISCHARGE DEVICE AND IMAGE FORMING APPARATUS

CROSS-REFERENCE TO RELATED APPLICATIONS

This application is based on and claims priority under 35 USC 119 from Japanese Patent Application No. 2007-253852 filed Sep. 28, 2007.

BACKGROUND

Technical Field

The present invention relates to a paper discharge device and an image forming apparatus.

SUMMARY

According to an aspect of the invention, a paper discharge device includes a discharge member, a paper carry portion, a first moving section, a pair of paper side end register sections, a second moving section, and a discharge paper control section. The discharge member discharges paper. The paper carry portion carries thereon paper discharged by the discharge member. The first moving section moves the discharge member in a paper width direction to shift the position of paper to be carried onto the paper carry portion. The pair of paper side end register sections holds the paper to be carried onto the paper carry portion from both sides in the paper width direction to register the position of the side end of the paper. The second moving section moves the pair of paper side end register sections in the paper width direction. The discharge paper control section, when the shifting direction of the paper by the first moving section is switched from one direction to the other direction in the paper width direction, controls the second moving section to move the pair of paper side end register section in the other direction in the paper width direction.

BRIEF DESCRIPTION OF THE DRAWINGS

Exemplary embodiments of the present invention will be described in detail based on the following figures, wherein.

DETAILED DESCRIPTION

Now, description will be given below in detail of a specific exemplary embodiment according to the invention with reference to the accompanying drawings.

Figure 1:
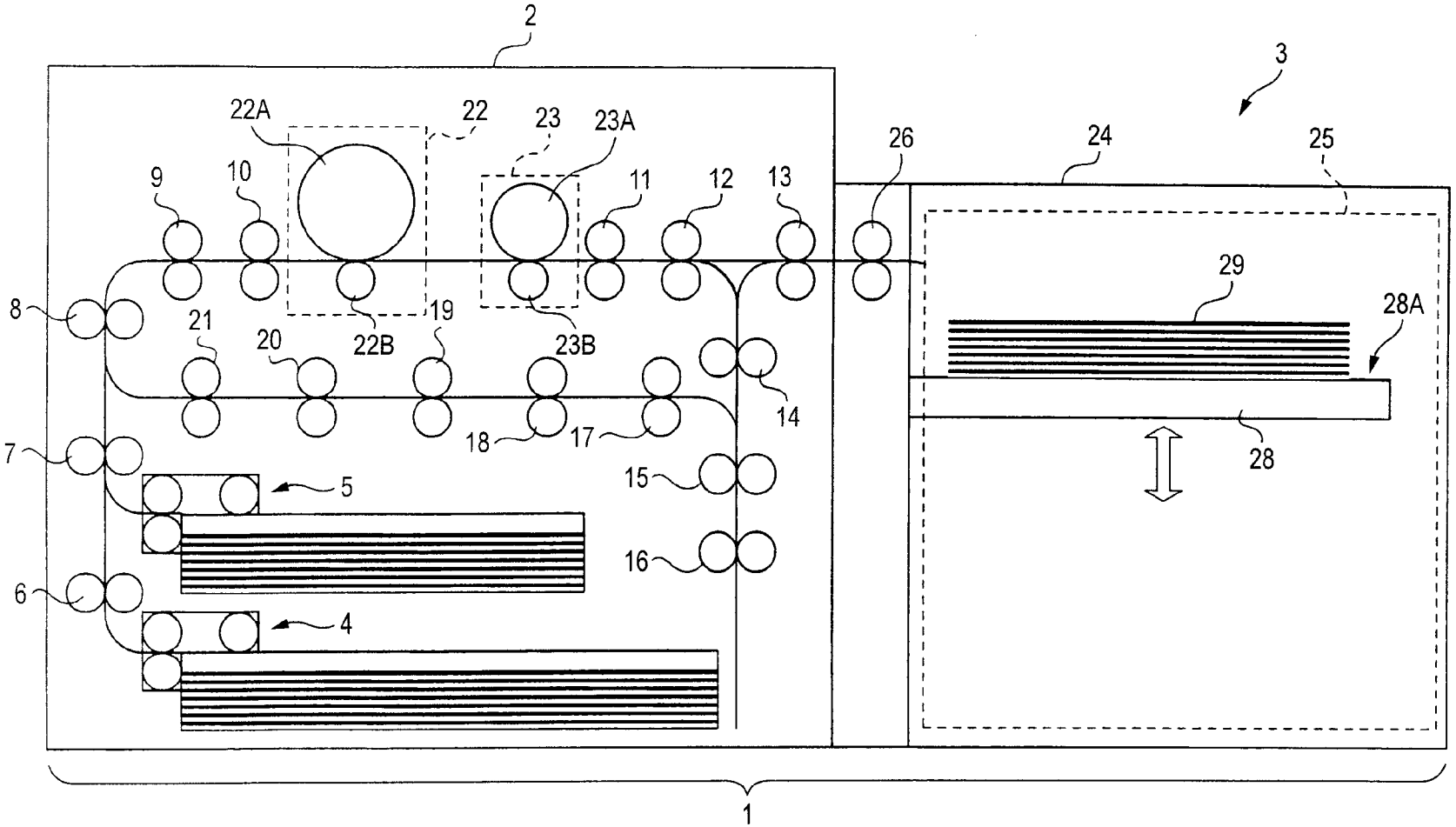
FIG. 1 is a schematic view of an example of the structure of an image forming apparatus to which the invention is applied.

FIG. 1 is a schematic view of an example of the structure of an image forming apparatus to which the invention is applied. The illustrated image forming apparatus 1 includes an image forming apparatus body 2 and a paper discharge device 3. In the image forming apparatus body 2, there are incorporated two paper feed devices 4 and 5 which are disposed in lower and upper stages respectively. Each of the paper feed devices 4 and 5 includes a paper storage portion having, for example, a tray shape, a cassette shape or a box shape, and a paper feed roller for feeding sheets of paper stored in the paper storage portion one by one sequentially in descending order.

Also, in the image forming apparatus body 2 includes a paper conveying passage which is used to convey sheets of paper fed thereto from the respective paper feed devices 4 and 5. The paper conveying passage is composed of a conveying passage forming member (not shown). On the paper conveying passage, there are disposed plural conveying rollers (paired rollers) 6~21 at given intervals.

On the paper conveying passage, between the conveying rollers 10 and 11, there are interposed an image transfer device 22 and an image fixing device 23. The image transfer device 22 is used to transfer an image (a toner image) to paper being conveyed along the paper conveying passage. The image transfer device 22 includes a sensitive drum 22A and a transfer roller 22B which are disposed opposed to each other with the paper conveying passage between them. Also, the image transfer device 22, although not shown, includes: a charger for charging the sensitive drum 22A; an image write device which, by applying a laser beam to the surface of the sensitive drum 22A charged to a given potential by the charger, exposes and scans such surface to thereby write an electrostatic latent image; and, a developing device for developing the electrostatic latent image written by the image write device using, for example, a two-component developer composed of a toner and a carrier.

The sensitive drum 22A and transfer roller 22B are disposed in such a manner that they are contacted with each other with a given amount of pressure. The sensitive drum 22A, when forming an image on the paper, is driven and rotated at a given speed in a counterclockwise direction in FIG. 1. The transfer roller 22B is structured such that, while rotating following the sensitive drum 22A, it holds the paper between the sensitive drum 22A and itself and applies an electric charge having the reversed polarity of the toner to thereby transfer a toner image on the sensitive drum 22A to the paper.

The image fixing device 23 is used to fix the image to the paper being conveyed along the paper conveying passage. The image fixing device 23 includes a heating roller 23A to be heated up to a given temperature (a fixing temperature) by a heater or the like, and a pressure roller 23B to be contacted with the heating roller 23A with a given amount of pressure.

The body of the paper discharge device (which is hereinafter referred to as "paper discharge device body") 24 includes a storage space 25 used to store sheets of paper with images formed thereon which are respectively discharged from the image forming apparatus body 2. The paper discharge device body 24 may be formed integrally with or separately from the image forming apparatus body 2.

On the paper discharge device 3, there are disposed a discharge roller 26 (an example of a discharge member) and, a paper carry base 28 (an example of a paper carry portion) The discharge roller 26 takes sheets of paper conveyed (discharged) by a conveying roller 13 in the image forming apparatus body 2 into the paper discharge device body 24, and also discharges the thus taken-in sheets of paper to the storage space 25. The discharge roller 26 is rotated so as to be synchronized with the conveying roller 13 provided on the image forming apparatus body 2.

The paper carry base 28, which is disposed in the storage space 25 within the paper discharge device body 24, carries thereon paper 29 discharged by the discharge roller 26. The upper surface 28A of the paper carry base 28 is disposed parallel to a horizontal plane. The paper carry base 28 is formed to have, for example, a tray shape and is structured such that the paper carry base 28 may be moved up and down in an elevator manner within the storage space 25.

In the above-structured image forming apparatus 1, the paper fed from one of the paper feed devices 4 and 5 is fed into the conveying roller 10 with the rotation of the conveying rollers 6, 7, 8 and 9. Next, with the rotation of the conveying roller 10, the paper is fed into the image transfer device 22. In the image transfer device 22, when the paper passes through between the sensitive drum 22A and transfer roller 22B, the toner image is transferred to the first surface of the paper.

Next, the paper is fed to the image fixing device 23. In the image fixing device 23, when the paper passes through between the heating roller 23A and pressure roller 23B, the toner image is fixed to the first surface of the paper. Next, as the conveying rollers 11 and 12 rotate, the paper is fed into the conveying roller 13 and further, with the rotation of the conveying roller 13, the paper is fed into the discharge roller 26.

And, in the paper discharge device 3, with the rotation of the discharge roller 26, the paper is discharged and the thus discharged paper is carried onto the paper carry base 28. The above-mentioned operations are the operations that are executed according to a one-surface image forming processing fox forming an image on one surface of paper.

In a double-surface image forming processing for forming images on both surfaces of the paper, the paper having passed through the image fixing device 23 is fed into the conveying rollers 14, 15 and 16 owing to the rotation of the discharge rollers 11 and 12. And, when, between the conveying rollers 14 and 15, the rear end of the paper passes through the fork position of the paper conveying passage toward the conveying roller 17, the rotation of the conveying rollers 15 and 16 is stopped once and, after then, the conveying rollers 15 and 16 are rotated in the reversed direction. Owing to this, the paper is fed into the conveying roller 17.

After then, with rotation of the conveying rollers 17, 18, 19, 20, 21, the paper is fed to the conveying roller 8 again. After then, according to a procedure similar to the procedure for forming the image on the first surface of the paper, an image is formed on (transferred and fixed to) the second surface of the paper.

The paper with the images formed on both surfaces thereof is fed sequentially through the conveying rollers 11, 12 and 13 into a discharge roller 26. Also, when the paper is discharged while it is turned inside out, after the paper is fed to the conveying roller 14 due to the rotation of the conveying rollers 11 and 12, the paper is fed to the conveying roller 13 owing to the reversed rotation of the conveying roller 14 and then the paper is fed to the discharge roller 26 owing to the rotation of the conveying roller 13.

Figure 2A:
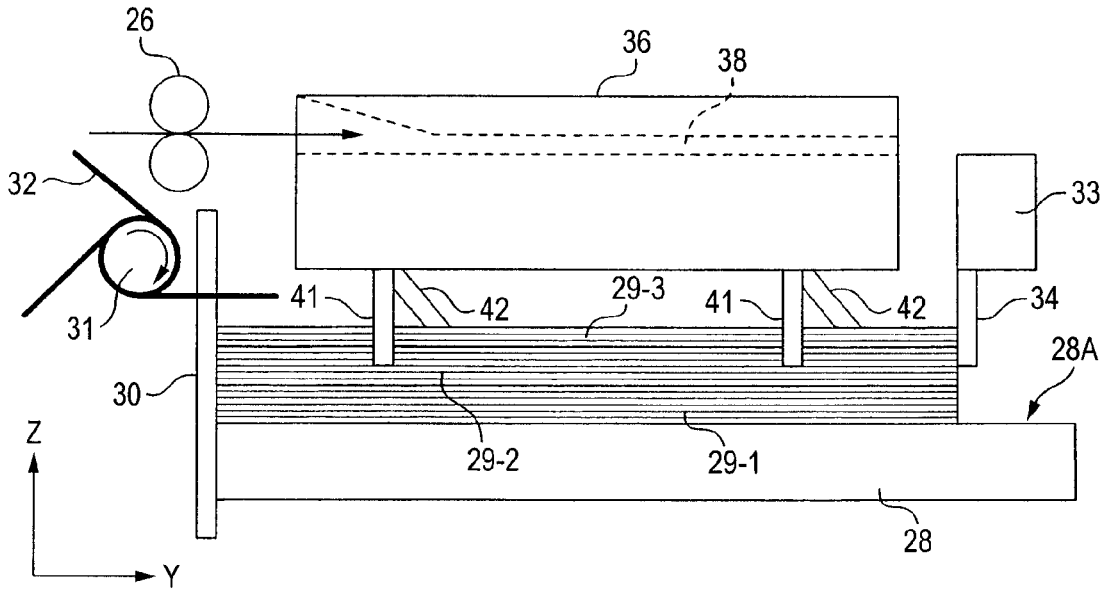
FIG. 2 is a view of an example of the interior structure of a paper discharge device.
Figure 2B:
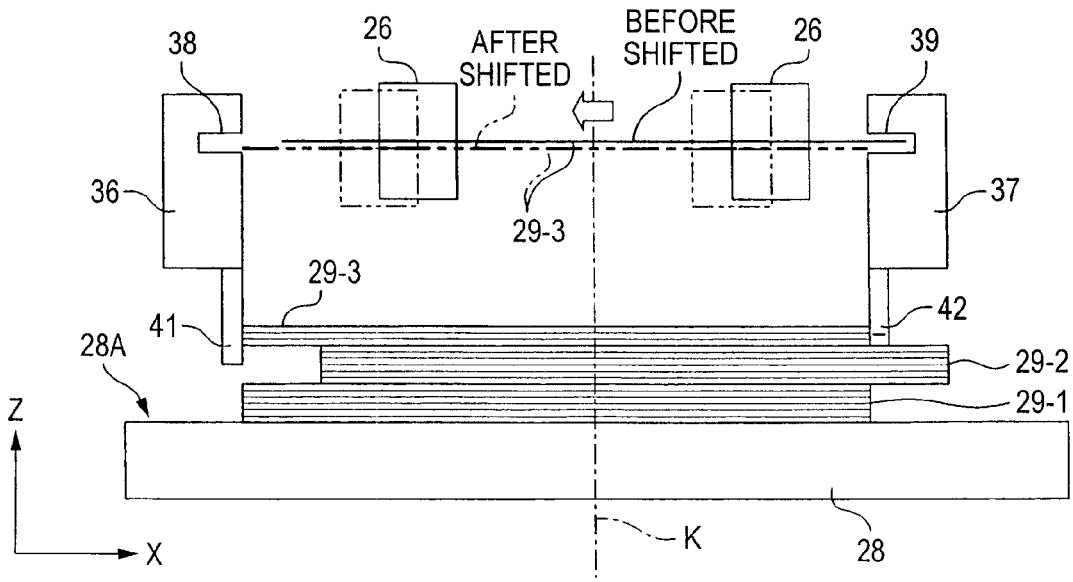

FIG. 2 shows an example of the interior structure of the paper discharge device 3. Specifically, FIG. 2A is a front view thereof, while FIG. 2B is a side view thereof.

In the present specification, the discharge direction (conveying direction) of the paper to be discharged by the discharge roller 26 is defined as the Y direction, while a direction parallel to the paper conveying surface and perpendicular to the paper discharge direction Y is defined as the paper width direction X. Also, a direction perpendicular to both of the paper discharge direction Y and paper width direction X is defined as the paper carry direction Z. In FIG. 2, the paper discharge direction Y and paper width direction X are respectively set in the horizontal direction, while the paper carry direction Z is set in the vertical direction (perpendicular direction).

Also, in the present specification, of the four end side portions of the paper which has a rectangular shape when it is viewed from above, the side end portion of the paper to be disposed facing downstream in the paper discharge direction Y is defined as the "leading end of the paper"; and, the end side portion of the paper to be disposed facing upstream in the paper discharge direction Y is defined as the "rear end of the paper". Also, the side end portion of the paper to be disposed facing in a direction parallel to the paper conveying surface and perpendicular to the paper discharge direction Y is defined as the "side end of the paper"

In FIG. 2, when, as one of image forming conditions (paper discharge conditions), there is specified a so called offset discharge mode for shifting the carry position of the paper in the width direction X, first moving section (not shown) moves the discharge roller 26 in the paper width direction X, whereby the position of the paper to be carried onto the paper carry base 28 is shifted in one direction (which is hereinafter referred to as a first direction) and in the other direction (which is hereinafter referred to as a second direction) in the paper width direction X. In the present specification, the movement of the paper in the paper width direction X is also referred to as "shift". As the first moving section, for example, there may be used a structure which drives a shifting motor (which will be discussed below) composed of a stepping motor or the like to thereby move the rotation axis of the discharge roller 26 in the axial direction of the discharge roller 26.

In this case, when, with respect to a center axis serving as the reference of the paper carry position in the paper width direction X (which is hereinafter referred to as "reference center axis"), a position obtained when the position of the paper to be carried onto the paper carry base 28 shifted by a given amount in the first direction (in FIG. 2, in the left direction) is expressed as a first carry position, and a position obtained when the above-mentioned position shifted by a given amount in the second direction (in FIG. 2, in the right direction) is expressed as a second carry position, sheets of paper 29-1 in the first stage are carried at the first carry position, sheets of paper 29-2 are carried at the second carry position, and sheets of paper 29-3 are carried at the first position.

A butt reference member 30 is composed of, for example, a plate-shaped member made of resin. The butt reference member 30 serves as a reference member which is used to register the rear end positions of the sheets of paper 29 discharged onto the paper carry base 28 by the discharge roller 26. The position of the butt reference member 36 is set fixed.

A draw member 31 is a member which includes plural (in the illustrated exemplary embodiment, three) paddle portions 32. The draw member 31 is made of, for example, rubber. The draw member 31 rotates clockwise in FIG. 2 each time when the discharge roller 26 discharges the paper 29, whereby the paddle portions 32 are allowed to draw the paper 29 towards the butt reference member 30. Owing to the drawing operation, the rear end of the paper 29 is butted against the butt reference member 30.

A paper leading end register unit 33 is disposed at a position which is opposed to the butt reference member 30 in the paper discharge direction Y. The paper leading end register unit 33 includes a leading end restrict member 34. The leading end restrict member 34 is used to restrict the leading end position of the paper 29 discharged by the discharge roller 26. The leading end restrict member 34 is disposed in such a manner that it projects downwardly of the main body portion of the paper leading end register unit 33. The position of the paper leading end register unit 33 in the paper discharge direction Y may be adjusted according to the length of the paper with the position of the butt reference member 30 as a reference.

That is, when the length of the paper is relatively large, the position of the paper leading end register unit 33 is adjusted such that the distance between the paper leading end register unit 33 and butt reference member 30 is made relatively long in order to correspond to the relatively large paper length. Also, when the length of the paper is relatively small, the position of the paper leading end register unit 33 is adjusted such that the distance between the paper leading end register unit 33 and butt reference member 30 is made relatively small in order to correspond to the relatively small paper length. By the way, the length of the paper means the dimension of the paper in the paper discharge direction Y.

Upwardly of the paper carry base 28, as an example of a pair of paper side end register section, there are disposed a pair of paper side end register units 36 and 37. The paper side end register unit 36 is disposed on one side in the paper width direction X, while the paper side end register unit 37 is disposed on the other side in the paper width direction X. The pair of paper side end register units 36 and 37 are disposed such that they are opposed to each other in the paper width direction X.

The distance between the two paper side end register units 36 and 37 can be adjusted according to the widths of the sheets of paper. That is, when the width of the paper is relatively large, the distance between the two paper side end register units 36 and 37 is adjusted to be relatively long in correspondence to the relatively large width; and, when the width of the paper is relatively small, the distance between the two paper side end register units 36 and 37 is adjusted to be relatively short in correspondence to the relatively small width. Here, the width of the paper means the dimension of the paper in the paper width direction X.

The pair of paper side end register units 36 and 37 are structured such that they may be moved in the paper width direction X by second moving section (not shown). As the second moving section, for example, there may be employed the following structure. That is, as a mechanism for moving the paper side end register unit 36, there may be employed a structure in which the main body portion of the paper side end register unit 36 is supported by a shaft (such as a round shaft) provided parallel to the paper width direction X in the storage space, a timing belt is provided parallel to the shaft in the paper width direction X, a portion of the timing belt in the peripheral length direction thereof is fixed to the main body portion of the paper side end register unit 36, and the timing belt is driven and traveled by a moving motor such as a stepping motor. Also, as a mode for moving the paper side end register units 36 and 37 using the second moving section, in an offset discharge mode, there are available not only a mode for moving the paper side end register units 36 and 37 integrally in the paper width direction so as to keep constant the distance between the paper side end register units 36 and 37, but also a mode for moving the paper side end register units 36 and 37 separately from each other so as to adjust the above-mentioned distance according to the width of the paper.

In the main body portion of the paper side end register unit 36, specifically, in the surface thereof that faces the paper side end register unit 37, there is formed a guide groove 38. The guide groove 38 is used not only to take therein one of the side edge portions of the paper 29 discharged by the discharge roller 26 to thereby avoid interference between the main body portion of the paper side end register unit 36 and paper 29 but also to prevent the drop of the paper 29 before the paper 29 is shifted. The groove width (clearance) of the guide groove 38 is set larger than the maximum thickness of the paper that is handled in the image forming apparatus 1. Also, the entrance portion of the guide groove 38 is formed in a spread and tapered shape in order to be able to facilitate the take-in of the paper 29. Similarly to this, in the main body portion of the paper side end register unit 37 as well, there is formed a guide groove 39.

Also, on the paper side end register unit 36, there are provided plural (in the illustrated exemplary embodiment, two) side end restrict members 41 in such a manner that they are shifted in position in the paper discharge direction Y; and, on the paper side end register unit 37 as well, there are provided plural (in the illustrated exemplary embodiment, two) side end restrict members 42 in such a manner that they are shifted in position in the paper discharge direction Y. The side end restrict members 41 are used to restrict the position of one of the side ends of the paper 29 discharged by the discharge roller 26, while the side end restrict members 42 are used to restrict the position of the other side end of the paper 29 discharged by the discharge roller 26. The side end restrict members 41 and 42 are respectively formed to have a rod shape. Also, the side end restrict members 41 and 42 use their mutually opposed surfaces as butt reference surfaces for restricting the positions of the side ends of the paper 29.

FIG. 2 shows a state in which paper (a paper bundle) 29-1 of a first stage and paper (a paper bundle) 29-2 of a second stage are carried sequentially onto the paper carry base 28, and paper (a paper bundle) 29-3 of a third stage is further being carried on top of the above-carried paper. The respective stages of paper 29-1, 29-2 and 29-3 are to be classified according to a unit of a given sheets of paper (for example, a unit of volumes and a unit of documents) specified by the image forming conditions.

Here, the paper carry surface means a surface on which the respective stages of paper 29-1, 29-2 and 29-3 are to be carried actually. Therefore, the paper carry surface for carrying the first stage of paper 29-1, the paper carry surface for carrying the second stage of paper 29-2 and the paper carry surface for carrying the third stage of paper 29-3 are different from each other. Specifically, the first stage of paper 29-1 is carried in such a manner that the upper surface 28A of the paper carry base 28 is used as the paper carry surface thereof. And, the second stage of paper 29-2 is carried in such a manner that the upper-most surface of the first stage of paper 29-1 is used as the paper carry surface thereof; and also, the third stage of paper 29-3 is carried in such a manner that the upper-most surface of the second stage of paper 29-2 is used as the paper carry surface thereof.

Also, as shown in FIG. 2B, in a state where the third stage of paper 29-3 is being carried, the side end restrict member 41 of the paper side end register unit 36 and the side end restrict member 42 of the paper side end register unit 37 are respectively projected downwardly. As can be seen from FIG. 2A, the side end restrict member 41 is disposed such that it extends parallel to the paper carry direction Z (in other words, it hangs down vertically), while the side end restrict member 42 is disposed such that it is inclined obliquely with respect to the paper carry direction Z. Also, the lower end portion (the projecting end portion) of the side end restrict member 41 is located at a position lower than the upper-most surface of the paper 29-2 of the second stage to provide the stage that is one stage lower than the third stage, while the lower end portion (the projecting end portion) of the side end restrict member 42 is located in such a manner that it is contacted with (it is carried on) the upper-most surface of the paper 29-2 of the second stage.

The main body portions of the paper side end register units 36 and 37 respectively include fine drive mechanisms which are used to reciprocate finely (fine move) their associated side end restrict members 41 and 42 in the paper width direction X. FIG. 3 shows an example of such fine drive mechanism.

Figure 3A:
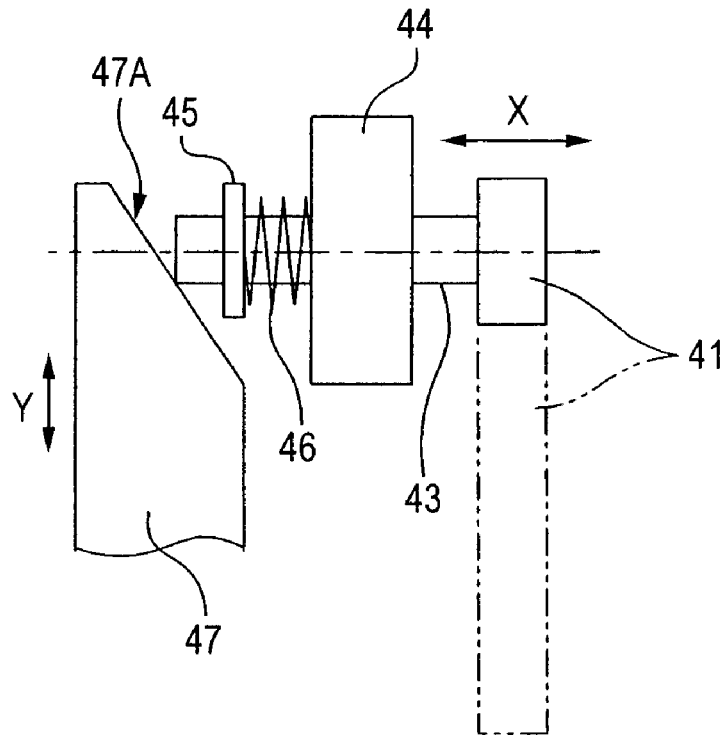
FIG. 3 is a view of an example of the structure of a fine driving mechanism.

Specifically, FIG. 3A shows an example of the structure of a fine drive mechanism that is provided in the paper side end register unit 36. The base end portion of the side end restrict member 41 is pressure inserted into one end of a support shaft 43 composed of a round shaft and is fixed thereto by adhesion or by similar way. The support shaft 43 is fitted with a shaft receive member 44. The shaft receive member 44 is a member which is to be fixed to the main body portion of the paper side end register unit 36. When the support shaft 43 fitted with the shaft receive member 44 is rotated, the side end restrict member 41 can be rotated (can be swung) about the support shaft 43. Therefore, when the support shaft 43 is rotated 90 degrees from its state shown in FIG. 2, the attitude of the side end restrict member 41 is varied from its vertical state to its horizontal state.

The shaft receive member 44 supports the support shaft 43 in such a manner that it allows the rotation of the support shaft 43 as well as allows the movement of the support shaft 43 in the paper width direction X. On the support shaft 43, there are provided a flame position 45. Also, on the support shaft 43, there is mounted a compression coil spring 46 serving as an elastic member. The compression coil spring 46 is interposed between the shaft receive member 44 and the flange portion 45 in the axial direction of the support shaft 43. Therefore, the support shaft 43 is energized in the left direction in FIG. 3A by the spring pressure of the compression coil spring 46.

The other end of the support shaft 43 is contacted with the inclined surface 47A of a translation cam 47 due to the spring pressure (energizing force) of the compression coil spring 46. The translation cam 47 can be moved reciprocatingly in the Y direction when it is driven by a fine moving motor (which will be discussed later). Here, in FIG. 3A, when the translation cam is moved in the upward direction, the support shaft 43 is pushed in the right direction against the spring pressure of the compression coil spring 46. Owing to this, the side end restrict member is moved in the right direction together with the support shaft 43. Also, when the translation cam 47 is moved in the downward direction, the support shaft 43 is pulled back in the left direction due to the spring pressure of the compression coil spring 46. Therefore, the side end restrict member 41 is moved in the left direction together with the support shaft 43.

Figure 3B:
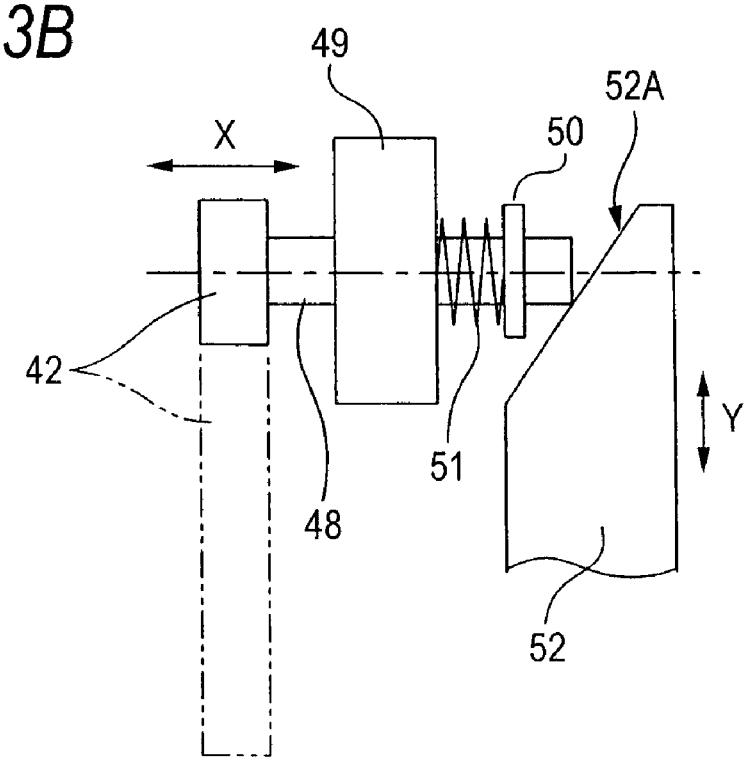

Accordingly, in the thus-structured fine drive mechanism, when the translation cam 47 reciprocates in the Y direction, the side end restrict member 41 reciprocates in the paper width direction X in linking with the reciprocating movement of the cam 47. Similarly to this, the main body portion of the paper side end register unit 37 also includes, as shown in FIG. 3B, a fine drive mechanism which uses a support shaft 48, a shaft receive member 49, a flange portion 50, a compression coil spring 51, a translation cam 52 and the like.

FIG. 4 shows an example of the structure of a rotate and drive mechanism which is used to rotate the side end restrict member. The rotate and drive mechanism includes a rotation motor 55 serving as a drive source, a drive pulley 56 fixed to the rotation shaft of the rotation motor 55, two driven pulley 57, 58 respectively provided so as to correspond to the two side end restrict members 41, and an endless belt provided on and between the drive pulley 56 and two driven pulleys 57, 58. The rotation motor 55 can be rotated in both directions (that is, it can be rotated forwardly and reversely) and it is composed of, for example, a stepping motor.

In this rotate and drive mechanism, on the side surfaces of the driven pulleys 57 and 58, there are provided stopper portions 57A and 58A respectively. The stopper portion 57A is fixed to the side surface of the driven pulley 57, while the stopper portion 58A is fixed to the side surface of the driven pulley 58. Therefore, when the driven pulley 57 is rotated, the stopper portion 57A is moved in an arc line manner around the rotation center of the driven pulley 57; and, when the driven pulley 58 is rotated, the stopper portion 58A is moved in an arc line manner around the rotation center of the driven pulley 58.

Figure 4A:
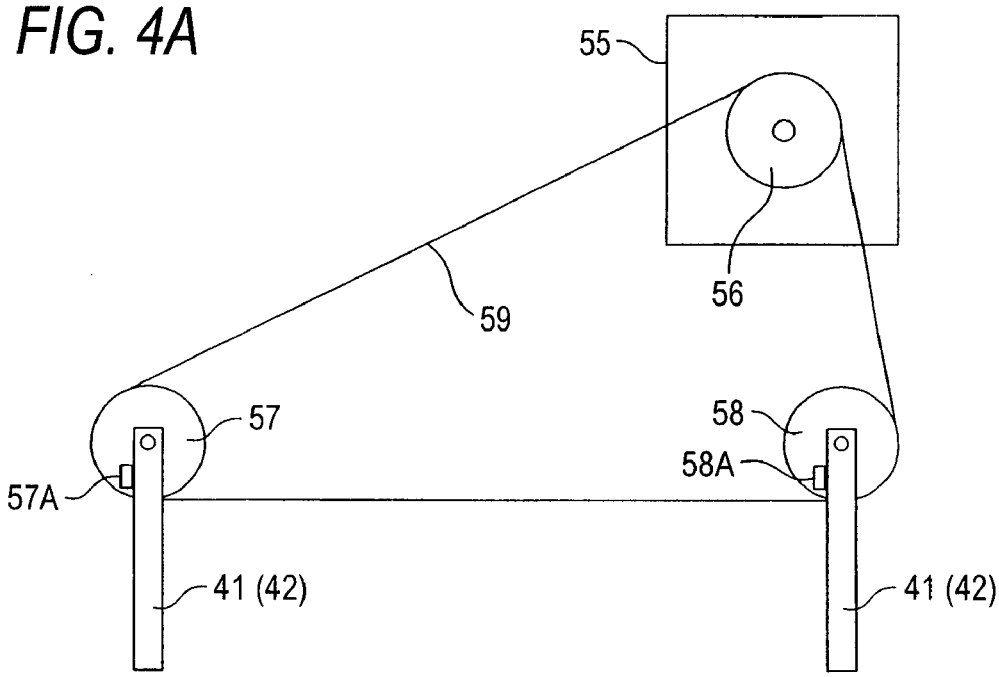
FIG. 4 is a view of an example of the structure of a rotate and drive mechanism.

The stopper portion 57A is disposed in such a manner that, when the driven pulley 57 is rotated counterclockwise from the state thereof shown in FIG. 4A, the stopper portion 57A can be butted against the side end restrict member 41. Also, the stopper portion 58A is disposed in such a manner that, when the driven pulley 58 is rotated counterclockwise from the state thereof shown in FIG. 4A, the stopper portion 58A can be butted against the side end restrict member 41.

Figure 4B:
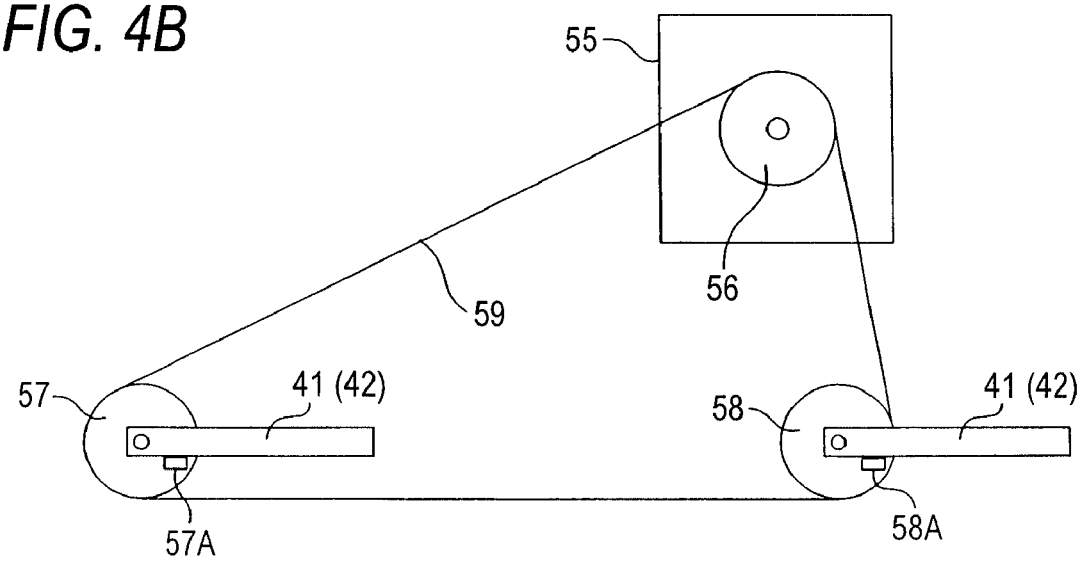

Therefore, when the driven pulleys 57 and 58 are rotated counterclockwise by 90 degrees from the state shown in FIG. 4A, the two side end restrict members 41 are respectively pushed up by their associated stopper portions 57A and 58A and are rotated counterclockwise, whereby they are respectively turned into the state shown in FIG. 4B. Also, when the driven pulleys 57 and 58 are rotated clockwise by 90 degrees from the state shown in FIG. 4B, the two side end restrict members 41 are respectively pushed up by their associated stopper portions 57A and 58A and are rotated clockwise, whereby they are respectively turned into the state shown in FIG. 4A.

Here, the respective rotation operations of the two side end restrict members 41 when the driven pulleys 57 and 58 are rotated clockwise in the above-mentioned manner may be carried out by using the dead weights (the action of gravity) of the respective side end restrict members 41 or by using the energizing force of an elastic member such as a spring.

The above-structured rotate and drive mechanism is provided in the main body portion of the paper side end register unit 36. And, a rotate and drive mechanism similar to this is provided in the main body portion of the paper side end register unit 37 as well. In the rotate and drive mechanism to be provided in the paper side end register unit 37, in FIGS. 4A and 4B, the side end restrict member 41 is replaced with the side end restrict member 42.

Figure 5:
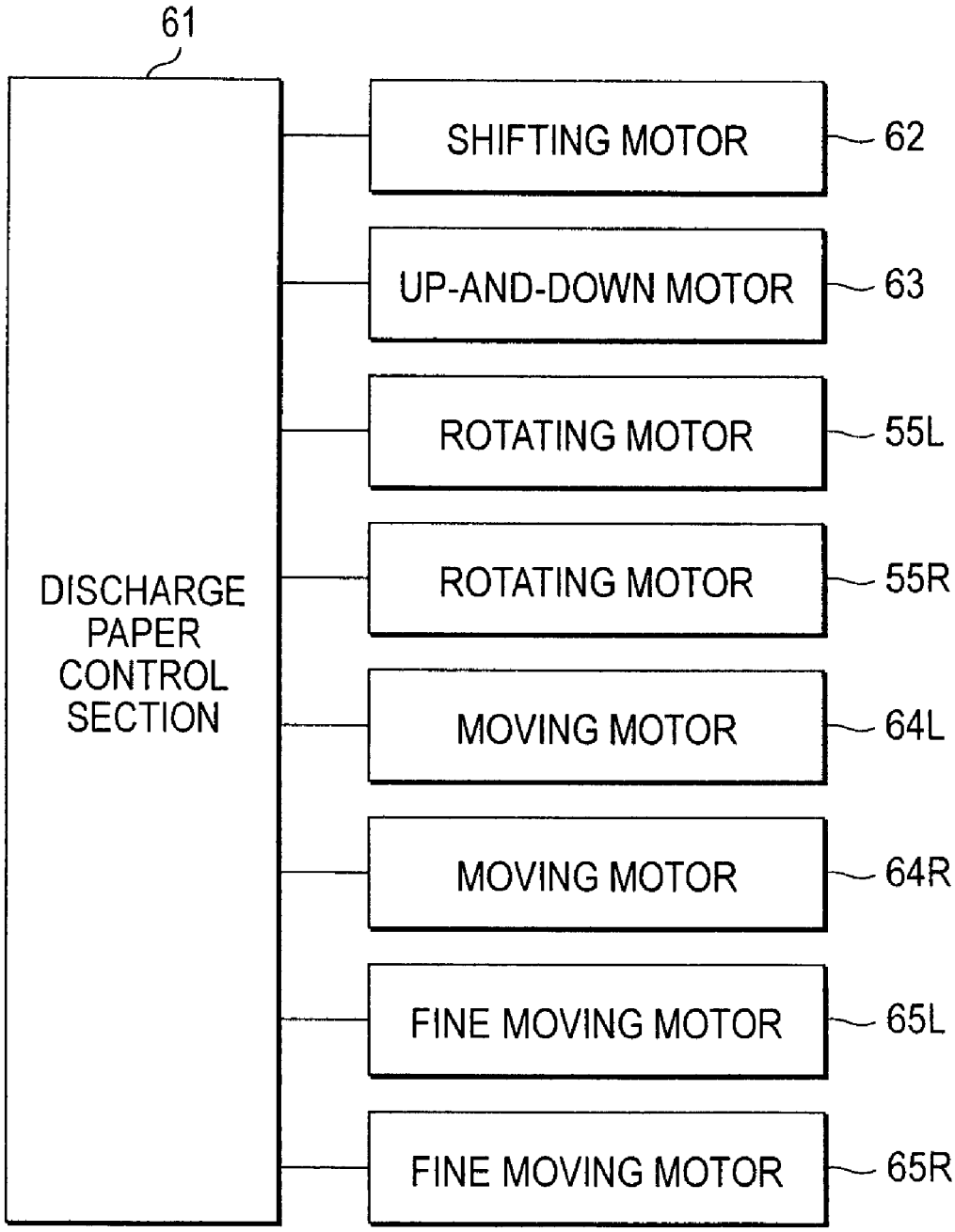
FIG. 5 is a block diagram of an example of the structure of a control system.

FIG. 5 is a block diagram of an example of the structure of a control system provided in the image forming apparatus 1, especially, a control system for controlling the operation of the paper discharge device 3. A paper discharge control section 61 is used to generally control a paper discharge operation to be executed by the paper discharge device 3. The paper discharge operation to be controlled includes the rotation operation of the discharge roller 26, the raising and failing operation of the paper carry base 28, the moving operations of the paper side end register units 36 and 37 in the paper width direction X, the fine moving operations of the side end restrict members 41 and 42 in the respective paper side end register units 36 and 37, the rotation operations of the side end restrict members 41 and 42 in the respective paper side end register units 36 and 37, and the like.

A shifting motor 62 serves as a drive source which is used to move the discharge roller 26 in the paper width direction X. An up-and-down motor 63 serves as drive source used to move up and down the paper carry base 28. Rotating motors 55L and 55R, as have been described above with reference to FIG. 4, respectively serve as drive sources used to rotate their associated side end restrict members 41 and 42. A moving motor 64L serves as a drive source used to move the paper side end register unit 36 in the paper width direction X, while a moving motor 64R serves as a drive source used to move the paper side end register unit 37 in the paper width direction X. A moving motor serving as second moving section may be structured by combining together the following two motors: that is, a motor for moving the paper side end register units 36 and 37 integrally in the paper width direction X; and, a motor for moving one of the paper side end register units (36 or 37) individually in the paper width direction X. Fine moving motors 65L and 65R, as have been described before with reference to FIG. 3A, respectively serve as drive sources (the drive sources of the fine drive mechanism) for fine reciprocating (fine moving) their associated side end restrict members 41 and 42 in the paper width direction X. The driving of the respective motors is generally controlled by the paper discharge control section 61.

In this case, the rising and falling operation of the paper carry base 28 to be driven by the up-and-down motor 63 is controlled in such a manner that, as the height of the paper 29 carried on the paper carry base 28 increases, the position of the paper carry base 28 lowers gradually (step by step). Therefore, when the paper carry base 28 receives the paper 29 discharged by the discharge roller 26 sequentially, the receiving position (height) of the discharged paper can be maintained substantially at a constant position regardless of the height of the paper 29 to be carried on the paper carry base 28.

By the way, description will be given later of how to control the moving operation of the discharge roller 26, the moving operations of the paper side end register units 36 and 37 as well as the fine moving operations and rotating operations of the side end restrict members 41 and 42.

Figure 6:
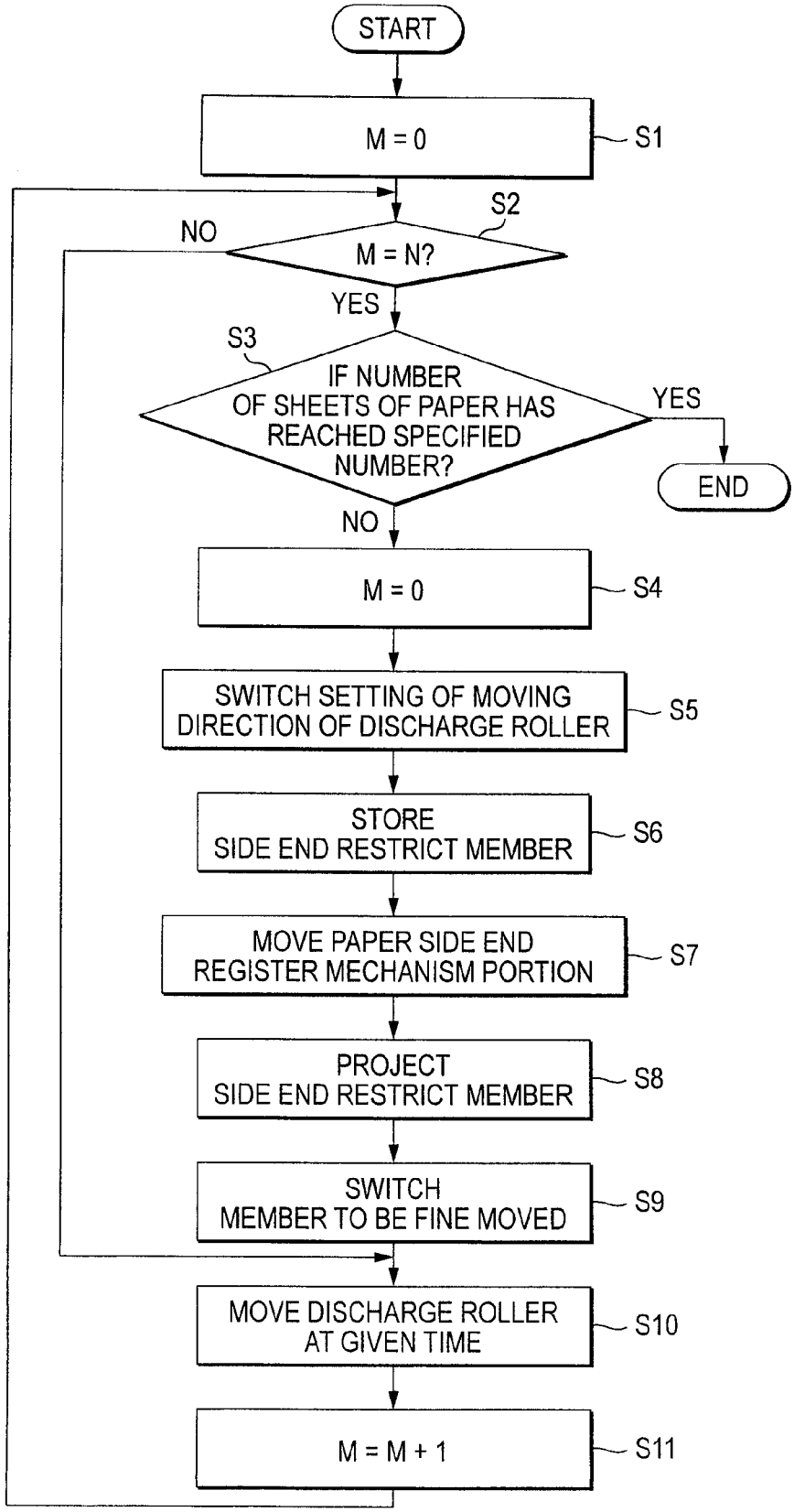
FIG. 6 is a flow chart of a procedure for processing to be executed by a paper discharge control section.

FIG. 6 is a flow chart of a procedure of processings to be executed by the paper discharge control portion 43 of the paper discharge device 3 when paper, on which an image has been formed within the image forming apparatus main body 2 of the image forming apparatus 1, is discharged to the paper discharge device 3. This processing procedure is applied in the above-mentioned offset discharge mode.

In a step of initiating an image forming processing, it is assumed that the moving direction of the discharge roller 26 for shifting the carry position of the paper 29 is set in the first direction as a default. In this case, the paper discharge control section 61 firstly resets a variable M to zero prior to the feeding of the paper 29 from the side of the image forming apparatus main body 2 (Step S1).

Next, the paper discharge control section 61 confirms whether the value of the variable M is equal to a given value N or not (Step S2). The value of the given value N, when the paper is classified according to a unit of a given sheets of paper, provides a value that shows the sheets of the paper (paper bundle) per unit. For example, when fifty sheets of paper are classified as one unit (paper bundle), the given value N is expressed such that N=50.

Next, the paper discharge control section 61, when the variable M is less than the given value N, moves the processing from Step S2 to Step S10. And, in Step S10, the shifting motor 62 is driven at a previously set given time (timing) to thereby move the discharge roller 26 currently discharging the paper 29 by a given amount in the first direction from the normal position thereof. After then, the paper discharge control section 61 increments the value of the variable M by 1 (Step S11) and, after then, moves the processing back to the above-mentioned step S2.

The given time is set between the time when the rear end of the paper fed from the image forming apparatus main body 2 passes through the conveying roller 13 and the time when such rear end passes through the discharge roller 26. In the step where the rear end of the paper 29 has passed through the discharge roller 26, the paper discharge control section 61 drives and rotates the shifting motor 62 in the opposite direction to the above-mentioned direction to thereby return the discharge roller 26 to the original position thereof, that is, the normal position thereof.

The normal position is the home position of the discharge roller 26 that is set using a home position sensor (not shown), for example, in the initializing operation of the apparatus when the power supply is put to work. In the paper discharge device 3, when the carry position of the paper 29 is not shifted in the paper width direction X, the paper 29 is discharged while the discharge roller 26 remains fixed to the normal position. In the paper width direction X, in a state where the discharge roller 26 is held at the normal position, the distances from the reference center axis K to the right and left discharge rollers 26 are equal to each other.

On the other hand, in the above-mentioned step S2, when it is found that the value of the variable M is equal to the given value N, the paper discharge control section 61 confirms whether the sheets of paper discharged by the discharge roller 26 after initiation of the image forming processing (the number of paper discharged) has reached the number of paper specified or not (Step S3). When the number of discharged paper has reached the specified number of paper, a series of processings are ended at the then time; and, when not reached, the variable M is reset to zero (Step S4). In this case, the processing for resetting the variable M may be carried out any time, provided that it is carried out before the processing advances to Step S10.

The specified number means a total number of sheets of paper that are used in the image forming processing. For example, when a document includes 50 pages of image data and three volumes each including the 50 pages of image data are printed on the paper according to a one-surface image forming processing, as described above, with 50 sheets of paper used as a unit, images are formed on a total of 150 sheets of paper. Thus, in this case, the specified number provides 150 sheets of paper.

Next, the paper discharge control section 61 switches the setting of the moving direction of the discharge roller 26 (Step S5). For example, when, in a stage where the value of the variable M coincides with the given value N in Step S2, the moving direction of the discharge roller 26 is set in the first direction, the setting of the moving direction is switched from the first direction to the second direction. Also, when, in a stage where the value of the variable M coincides with the given value N in Step S2, the moving direction of the discharge roller 26 is set in the second direction, the setting of the moving direction is switched from the second direction to the first direction.

The moving direction of the discharge roller 26 depends on the rotation direction of the shifting motor 62. Therefore, to switch the setting of the moving direction of the discharge roller 26 is synonymous with the switching of the setting of the rotation direction of the shifting motor 62. When the shifting motor 62 is driven in the above-mentioned step S10, the rotation direction of the shifting motor 62 when the moving direction of the discharge roller 26 is set in the first direction is opposite to the rotation direction of the shifting motor 62 when the moving direction of the discharge roller 26 is set in the second direction.

Next, the paper discharge control section 61 drives the rotating motors 55L and 55R so as to turn the state shown in FIG. 4A into the state shown in FIG. 4B, whereby the side end restrict members 41 and 42 respectively corresponding to the rotating motors 55L and 55R are stored into the main body portions of the paper side end register units 36 and 37 respectively (Step S6). Owing to this, the respective side end restrict members 41 and 42 are allowed to withdraw from the paper carry surface to their respective retreat positions and, more specifically, to their retreat positions (upper positions) that are higher than the upper-most surface of the paper carried on the paper carry surface.

Next, the paper discharge control section 61 drives the moving motors 64L and 64R to thereby move the paper side end register units 36 and 37 in the paper width direction X in correspondence to the switching of the moving direction in the above-mentioned step S5 (Step S7). For example, when the moving direction of the discharge roller 26 is switched from the first direction to the second direction, the paper side end register units 36 and 37 are moved in the second direction in correspondence to the switching of the moving direction of the discharge roller 26. Also, when the moving direction of the discharge roller 26 is switched from the second direction to the first direction, the paper side end register units 36 and 37 are moved in the first direction in correspondence to the switching of the moving direction of the discharge roller 26. In this case, the amount of the movement of the paper side end register units 36 and 37 is equivalent to the amount of the shift of the paper between the above-mentioned first and second carry positions.

Next, the paper discharge control section 61 drives the rotating motors 55L and 55R so as to turn the state shown in FIG. 4B into the state shown in FIG. 4A, whereby their associated side end restrict members 41 and 42 are respectively projected downwardly of the main body portions of the paper side end register units 36 and 37 (Step S8). As a result of this, the side end restrict members 41 and 42 are respectively moved to their projecting positions where they project toward the paper carry surface. In this case, the lower end portion of one of the side end restrict members (41 and 42) is contacted with the upper-most surface of the paper 29 in the stage that exists one stage lower than the current stage.

Next, the paper discharge control section 61, in order to switch the member to be fine moved between the pair of side end restrict members 41 and 42, not only fine moves the side end restrict member that has been held stationary (has been fixed) until then but also switches the driving of the fine moving motors 65L and 65R so as to cause the side end restrict member, which has been fine moved until then, to rest (Step S9). In this case, the paper discharge control section 61 not only fine moves the side end restrict member distant from the reference center axis K but also controls the side end restrict member near to the reference center axis K so as to rest.

According to the present exemplary embodiment, it is assumed that, before the first sheet of paper 29 is discharged by the discharge roller 26, only the fine moving motor 65L is driven while stopping the fine moving motor 65R. In this case, when, in the stage where the value of the variable M coincides with the given value N in the above-mentioned step S2, the fine moving motor 65L is driven and the fine moving motor 65R is stopped, the paper discharge control section 61, by switching the member to be fine moved in the above-mentioned step S9, initiates the driving of the fine moving motor 65R to thereby stop the driving of the fine moving motor 65L. Also, when, in the stage where the value of the variable M coincides with the given value N in the above-mentioned step S2, the fine moving motor 65R is driven and the fine moving motor 65L is stopped, the paper discharge control section 61, by switching the member to be fine moved in the above-mentioned step S9, initiates the driving of the fine moving motor 65L to thereby stop the driving of the fine moving motor 65R. After Step S9, the processing goes to Step 10, where the above-mentioned processings are similarly executed repeatedly.

FIGS. 7~10 respectively show the flow of the operation to be executed by the paper discharge device 3 based on the above-mentioned processing procedure. Firstly, in a stage before the discharge roller 26 discharges the first sheet of paper, as shown in FIG. 7A, the lower end portions of the side end restrict members 41 and 42 of the paper side end register units 36 and 37 are contacted with the upper surface 28A of the paper carry base 28 that provides the paper carry surface in this stage.

Figure 7A:
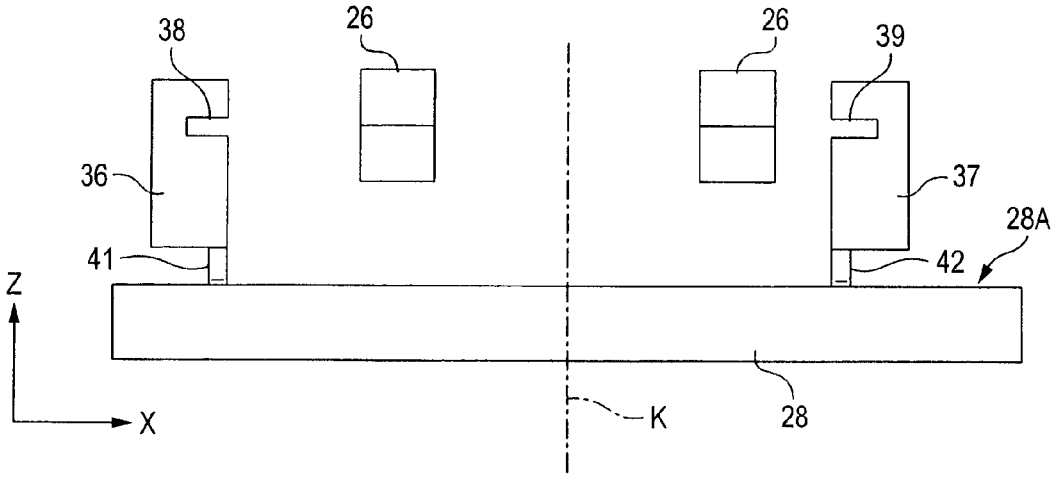
FIG. 7 is a view of the flow of the operation of the paper discharge device (1/4)
Figure 7B:
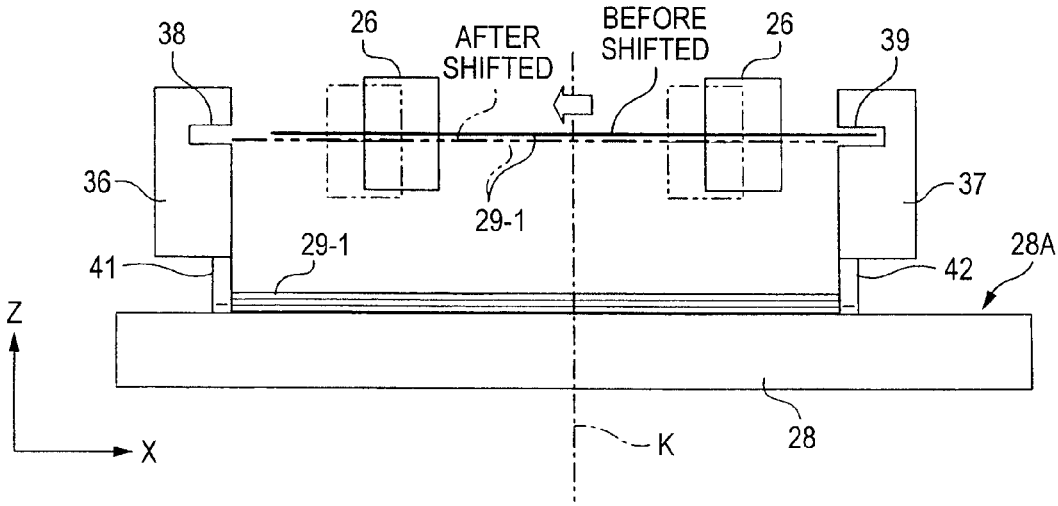

After then, in the stage where the paper 29-1 of the first stage is being carried onto the paper carry base 28, as shown in FIG. 7B, while the side end restrict members 41 and 42 remain contacted with the upper surface 28A of the paper carry base 28, the discharge operation and shifting operation of the paper 29-1 by the discharge roller 26 are carried out. As a result of this, the paper side end positions of the sheets of paper 29-1 of the first stage are registered while they are sandwiched by and between the side end restrict members 41 and 42 from both sides in the paper width direction X.

Figure 11A:
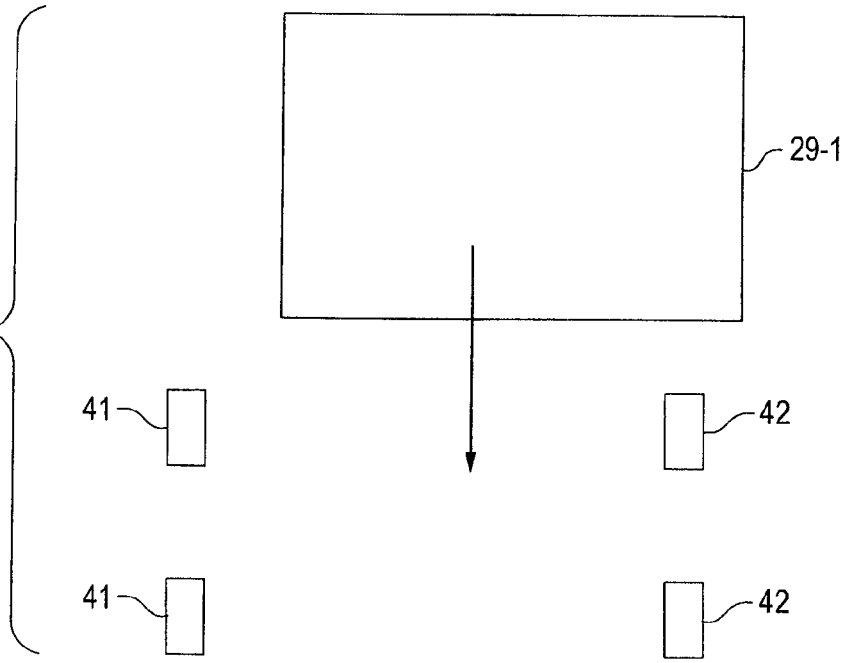
FIG. 11 is a plan view to show the position relationship between paper and side end restrict member.

In this operation, the side end restrict member 41, which is located on the left in FIG. 7B (is distant from the reference center axis K), is moved fine because it is driven by the fine moving motor 65L; and the side end restrict member 42, which is located on the right in FIG. 7B (is near to the reference center axis K), is kept stationary because the fine moving motor 65R is stopped. Also, in the stage prior to the shifting operation of the paper 29-1 by the discharge roller 26, the side edge portion of the paper 29-1 is taken into the guide groove 39 of the paper side end register unit 37 to thereby prevent the paper 29-1 from falling down. Therefore, even when, as shown in FIG. 11A, the side end restrict member 42 is situated inwardly of the side end position of the paper 29-1 before the discharge roller 26 is shifted, there is no possibility that the leading end of the paper 29-1 can be butted against the side end restrict member 42 before the discharge roller 26 is shifted.

Figure 8A:
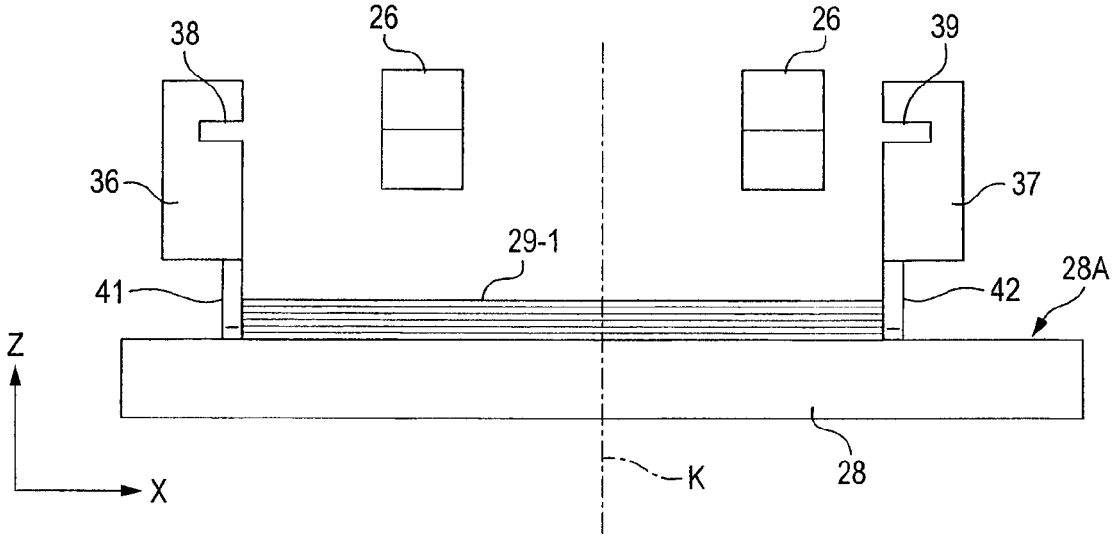
FIG. 8 is a view of the flow of the operation of the paper discharge device (2/4)
Figure 8B:
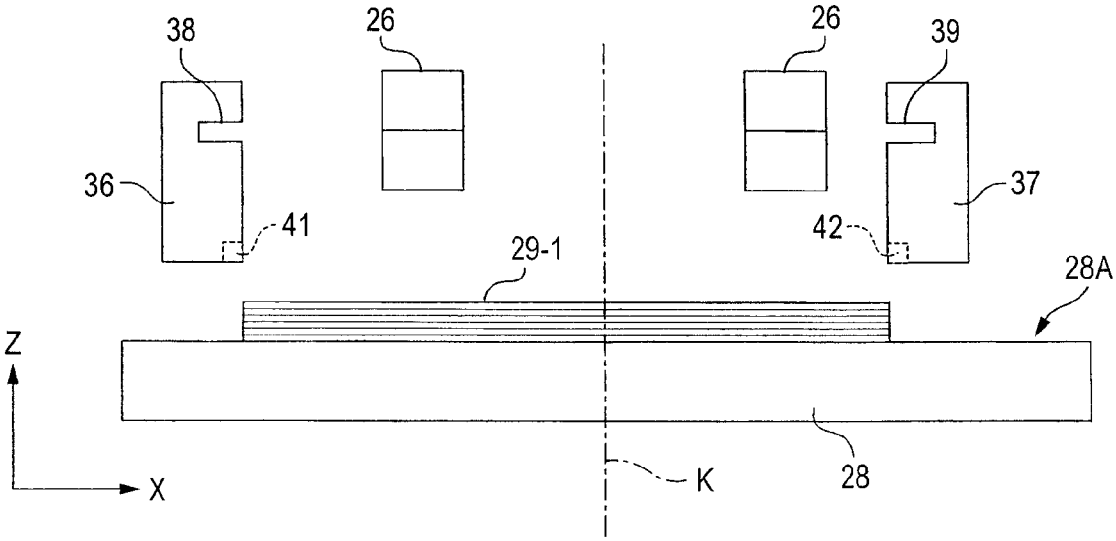

After then, in a stage where the paper 29-1 of the first stage is carried by a given number (N sheets of paper) on the upper surface 28A of the paper carry base 28, the operation of the paper discharge apparatus 3 is turned from a state where, as shown in FIG. 8A, the lower end portions of the side end restrict members 41 and 42 are contacted with the upper surface 28A of the paper carry base 28 to a state where, as shown in FIG. 8B, the side end restrict members 41 and 42 are respectively stored into the main body portions of their associated paper side end register units 36 and 37. As a result of this, the side end restrict members 41 and 42 are retreated to the positions that are situated upwardly of the upper-most surface of the paper 29-1 of the first stage carried on the upper surface 28A of the paper carry base 28.

Figure 9A:
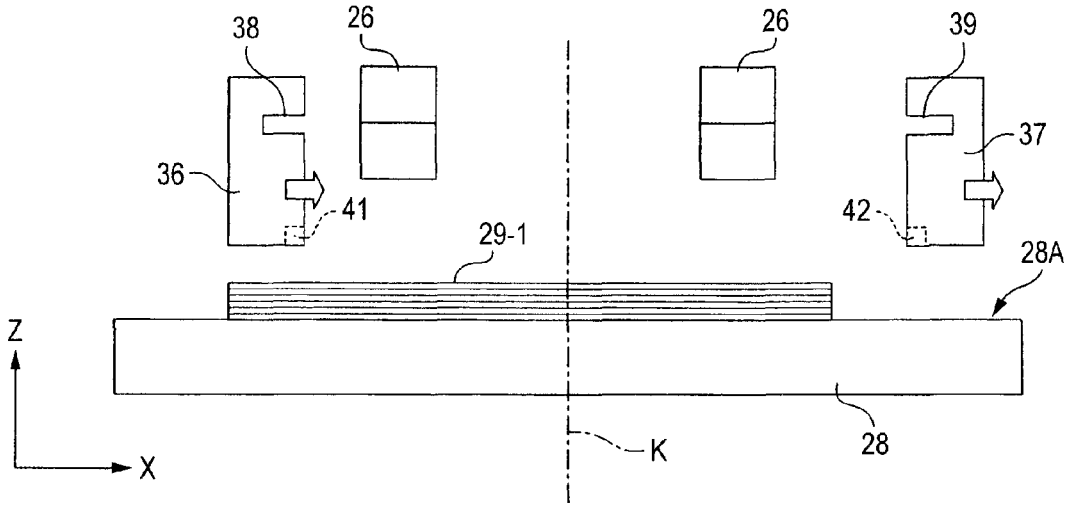
FIG. 9 is a view of the flow of the operation of the paper discharge device (3/4)

Next, the paper side end register units 36 and 37, as shown in FIG. 9A, move in one direction in the paper width direction X. In this case, the paper side end register unit 36 moves by a given amount in a direction to approach the reference center axis K, while the paper side end register units 37 moves by a given amount to part away from the reference center axis K.

Figure 9B:
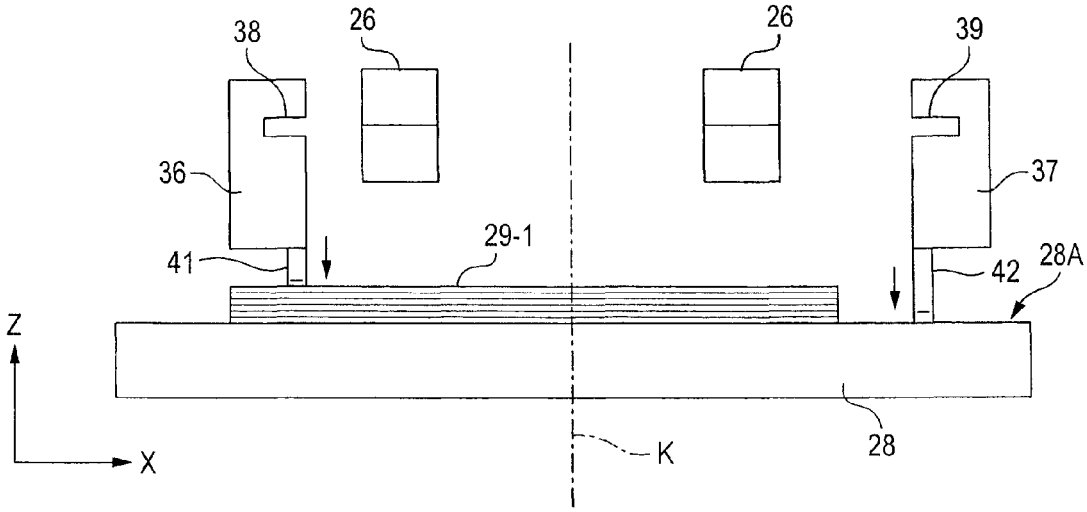

Next, as shown in FIG. 9B, the side end restrict members 41 and 42 are projected from the main body portions of the paper side end register units 36 and 37 respectively. In this case, the lower end portion of the side end restrict member 41 is contacted with the upper-most surface of the paper 29-1 of the first stage, while the lower end portion of the side end restrict member 42 is contacted with the upper surface 28A of the paper carry base 28. Also, in this case, provided that the lower end portion of the side end restrict member 42 is always left situated at a position lower than the upper-most surface of the paper 29-1 of the first stage until the carrying operation of the paper 29-2 of the next stage is finished, the lower end portion of the side end restrict member 42 may also be allowed to exist upwardly of the upper surface 28A of the paper carry base 28 in this stage.

Figure 10A:
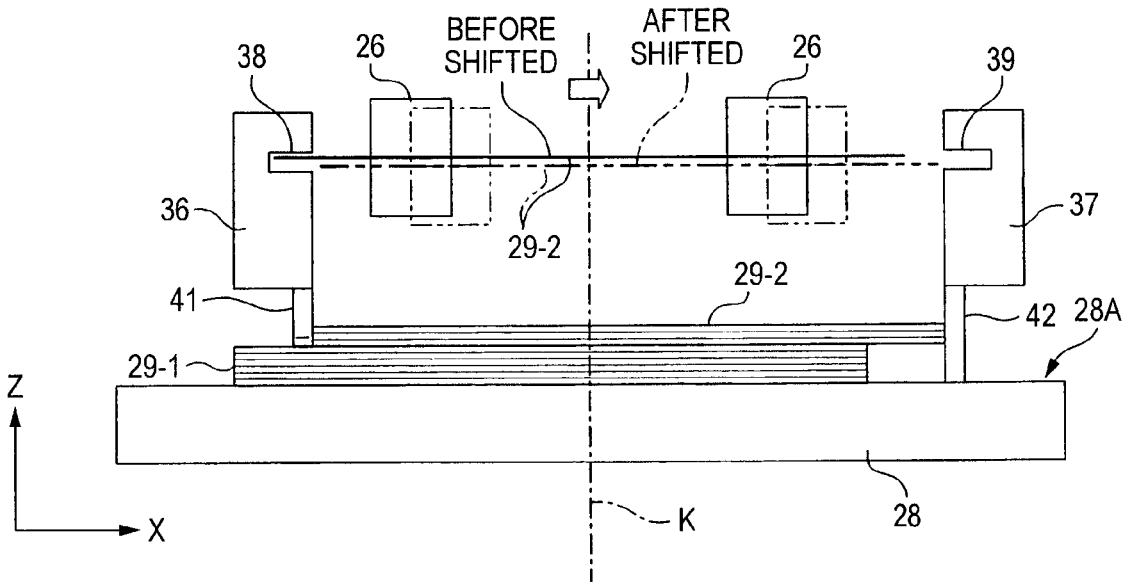
FIG. 10 is a view of the flow of the operation of the paper discharge device (4/4)

After then, in a stage where the paper 29-2 of the second stage is being carried onto the paper carry base 28, as shown in FIG. 10A, while the lower end portion of the side end restrict member 41 remains contacted with the upper-most surface of the paper 29-1 of the first stage that provides a paper carry surface in this stage, the discharge operation and shifting operation of the paper 29-2 by the discharge roller 26 are carried out. As a result of this, the paper side end positions of the sheets of the paper 29-2 of the second stage are registered while they are sandwiched by and between the side end restrict members 41 and 42 from both sides in the paper width direction X.

Figure 10B:
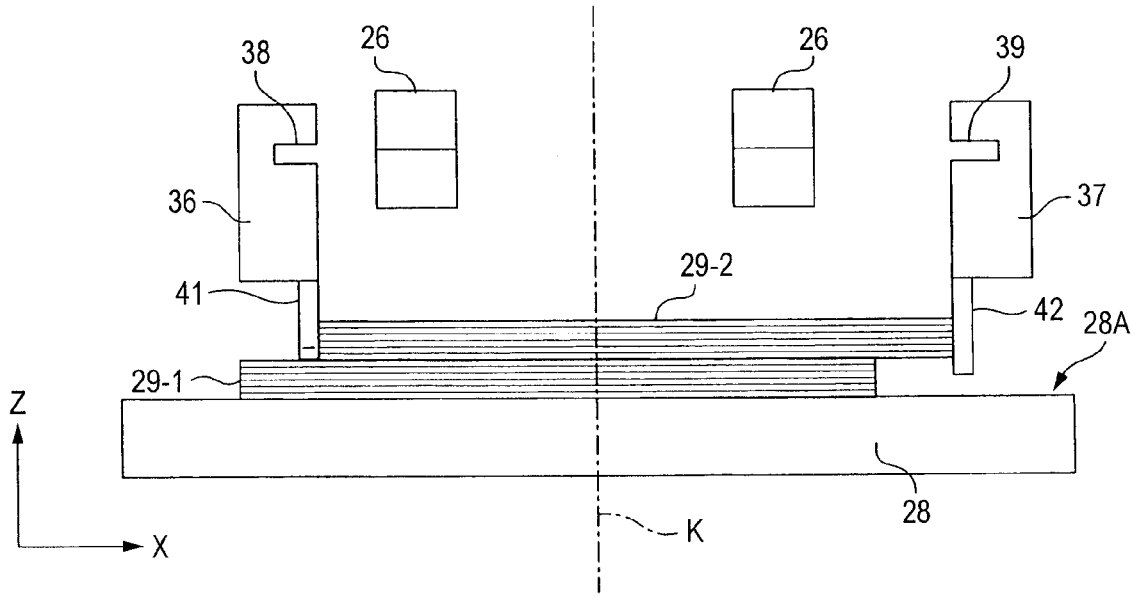
Figure 11B:
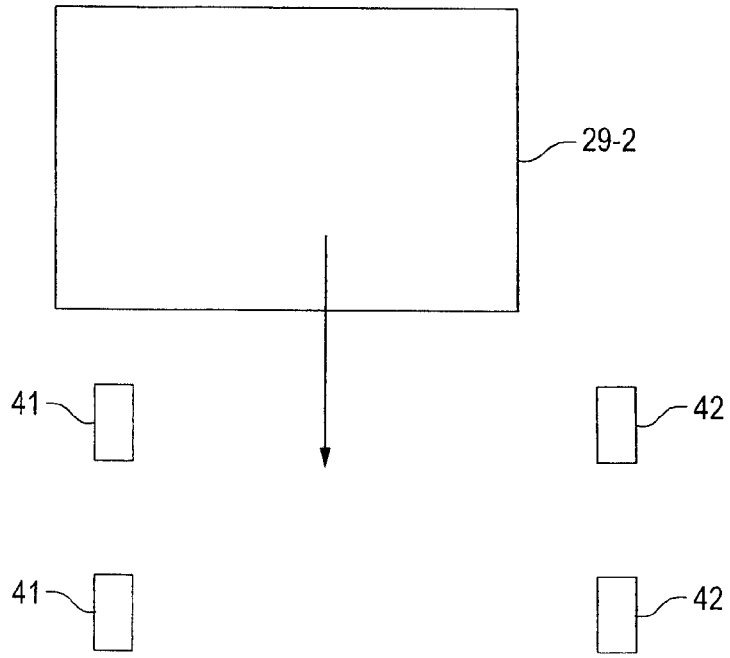

In this operation, the side end restrict member 42, which is located on the right in FIG. 10A (is distant from the reference center axis K), is fine moved because it is driven by the fine moving motor 65R; and the side end restrict member 41, which is located on the left in FIG. 10B (is near to the reference center axis K), is kept stationary because the fine moving motor 65L is stopped. Also, in the stage prior to the shifting operation of the paper 29-2 by the discharge roller 26, the side edge portion of the paper 29-2 is taken into the guide groove 38 of the paper side end register unit 36 to thereby prevent the paper 29-2 from falling down. Therefore, even when, as shown in FIG. 11B, the side end restrict member 41 is situated inwardly of the side end position of the paper 29-2 before the paper 29-2 is shifted by the discharge roller 26, there is no possibility that the leading end of the paper 29-2 can be butted against the side end restrict member 41 before the discharge roller 26 is shifted.

After then, in a stage where the paper 29-2 of the second stage is carried by a given number (N sheets of paper) on the upper-most surface of the paper 29-1 of the first stage, as shown in FIG. 10B, the lower end portion of the side end restrict member 41 is contacted with the upper-most surface of the paper 29-1 of the first stage and the lower end portion of the side end restrict member 42 is situated at a position (space) lower than the upper-most surface of the paper 29-1 of the first stage.

After then, according to a procedure similar to the procedure that has been described with reference to the above-mentioned FIGS. 8A, 8B and 9A, 9B, the storing (retreating) operations of the side end restrict members 41 and 42, the moving operations of the paper side end register units 36 and 37, and the projecting operations of the side end restrict members 41 and 42 are carried out. And, in a stage where the paper 29-3 of a third stage are being carried onto the paper carry base 28, as shown in the above-mentioned FIG. 2B, while the lower end portion of the side end restrict member 42 remains contacted with the upper-most surface of the paper 29-2 of the second stage that provides a paper carry surface in this stage, the discharge operation and shifting operation of the paper 29-3 by the discharge roller 26 are carried out. As a result of this, the paper side end positions of the sheets of the paper 29-3 of the third stage are registered while they are sandwiched by and between the side end restrict members 41 and 42 from both sides in the paper width direction X.

In this operation, the side end restrict member 41, which is located on the left in FIG. 2B (is distant from the reference center axis K), is moved fine because it is driven by the fine moving motor 65L; and the side end restrict member 42, which is located on the right in FIG. 2B (is located nearer to the reference center axis K), is kept stationary because the fine moving motor 65R is stopped. Also, in the stage prior to the shifting operation of the paper 29-3 by the discharge roller 26, the side edge portion of the paper 29-3 is taken into the guide groove 39 of the paper side end register unit 37 to thereby prevent the paper 29-3 from falling down. Therefore, similarly to the above-mentioned case, even when the side end restrict member 42 is situated inwardly of the side end position of the paper 29-3 before the discharge roller 26 is shifted, there is no possibility that the leading end of the paper 29-3 can be butted against the side end restrict member 42 before the discharge roller 26 carries out the paper shifting operation.

The present invention can apply not only to an image forming apparatus such as a printer, a copying machine, a fax machine and a composite machine but also to a paper discharge device which is connected to and used in the image forming apparatus or other paper processing apparatus.

What is claimed is:

1. A paper discharge device, comprising:

a discharge member that discharges paper;

a paper carry portion that carries thereon paper discharged by the discharge member;

a first moving section that moves the discharge member in a paper width direction to shift a paper carry position at which the paper is carried onto the paper carry portion;

a pair of paper side end register sections that holds the paper carried onto the paper carry portion from both sides of the paper in the paper width direction to register position of side ends of the paper;

a second moving section that moves the pair of paper side end register sections in the paper width direction; and a discharge paper control section that, when the shifting direction of the paper by the first moving section is switched from one direction to another direction of the paper width direction, controls the second moving section to move the pair of paper side end register sections in said another direction of the paper width direction, wherein each of the pair of paper side end register sections includes a side end restrict member that restricts the side end position of the paper to be carried onto the paper carry portion, and when sheets of paper are discharged by the discharge member and are carried onto the paper carry portion from a first stage while shifting the paper carry position whenever a given number of sheets of paper are discharged, the discharge paper control section controls the side end restrict members in such a manner that, paper of an i-th stage is discharged by the discharge member in a state where one of the side end restrict members located nearer to a center axis defined as a reference for the paper carry position in the paper width direction than the other is in contact with the upper-most surface of sheets of paper of an (i-1)th stage, where i is a natural number equal to or larger than 2.

2. The paper discharge device according to the claim 1, wherein each of the pair of paper side end register sections comprises a driving mechanism that operates the side end restrict member between a projecting position, where the side end restrict member projects toward a paper carry surface in a direction substantially perpendicular to the paper carry surface, and a retreat position retreated from the paper carry surface.

3. The paper discharge device according to claim 2, wherein the driving mechanism operates the side end restrict member by rotating the side end restrict member.

4. The paper discharge device according to claim 2, wherein each of the pair of paper side end register sections comprise a horizontally extending groove configured to hold the paper to prevent it from dropping onto the paper carrying portion.

5. The paper discharge device according to claim 1, wherein the paper discharge control section controls the side end restrict members in such a manner that the paper discharge control section moves the other of the side end restrict members farther from the center axis in the paper width direction, while the paper discharge control section holds stationary the one of the side end restrict member located nearer to the center axis.

6. The paper discharge device according to the claim 1, wherein each of the pair of paper side end register sections comprise a horizontally extending groove configured to hold the paper to prevent it from dropping onto the paper carrying portion.

7. A paper discharge device, comprising:

a discharge member that discharges paper;

a paper carry portion that carries thereon paper discharged by the discharge member;

a first moving section that moves the discharge member in a paper width direction to shift a paper carry position at which the paper is carried onto the paper carry portion between a first paper carry position and a second paper carry position;

a pair of paper side end register sections that holds the paper carried onto the paper carry portion from both sides of the paper in the paper width direction to register positions of side ends of the paper;

a second moving section that moves the pair of paper side end register sections in the paper width direction; and a discharge paper control section that, when the shifting direction of the paper by the first moving section is switched from one direction to another direction of the paper width direction, controls the second moving section to move the pair of paper side end register sections in said another direction of the paper width direction, wherein each of the pair of paper side end register sections includes a side end restrict member that restricts the side end position of the paper to be carried onto the first or second paper carry portion, the paper discharge control section controls the discharge member and the first moving section to discharge and carry a given number of sheets of paper at a first paper carry position on the paper carry position, the paper discharge control section controls the discharging member and the first moving section to discharge a given number of sheets of paper at a second paper carry position on the given number of sheets of paper carried at the first paper carry position, a center axis is defined as a reference for the first and second paper carry positions in the paper width direction, and during a period in which the discharge member is discharging the given number of sheets of paper to the second paper carry position, the paper discharging control section controls one of the side end restrict members located nearer to the center axis than the other to be in contact with the upper-most surface of paper of the given number of sheets of paper carried at the first paper carry position.

8. The paper discharge device according to claim 7, wherein each of the pair of paper side end register sections comprise a horizontally extending groove configured to hold the paper to prevent it from dropping onto the paper carrying portion.

9. An image forming apparatus, comprising:

an image forming section that forms an image on paper, a discharge member that discharges paper;

a paper carry portion that carries thereon paper discharged by the discharge member;

a first moving section that moves the discharge member in the paper width direction to thereby shift a paper carry position at which the paper is carried onto the paper carry portion;

a pair of paper side end register sections that holds the paper carried onto paper carry portion from both sides of the paper in the paper width direction to thereby register positions of side ends of the paper;

a second moving section that moves the pair of paper side end register sections in the paper width direction; and a discharge paper control section, when the shifting direction of the paper by the first moving section is switched from one direction to another direction of the paper width direction, controls the second moving section to move the pair of paper side end register sections in said another direction of the paper width direction, wherein each of the pair of paper side end register sections includes a side end restrict member that restricts the side end positional of the paper to be carried onto the paper carry portion, and when sheets of paper are discharged by the discharge member and are carried onto the paper carry portion from a first stage while shifting the paper carry position whenever a given number of sheets of paper are discharged, the discharge paper control section controls the side end restrict members in such a manner that, paper of an i-th stage is discharged by the discharge member in a state where one of the side end restrict members located nearer to a center axis defined as a reference for the paper carry position in the paper width direction than the other is in contact with the upper-most surface of sheets of paper of an (i-1)th stage, where i is a natural number equal to or larger than 2.

10. The image forming apparatus according to claim 9, wherein each of the pair of paper side end register sections comprises a mechanism that operates the side end restrict member between a projecting position, where the side end restrict member projects toward a paper carry surface in a direction substantially perpendicular to the paper carry surface, and a retreat position retreated from the paper carry surface.

11. The image forming apparatus according to claim 10, wherein the driving mechanism operates the side end restrict member by rotating the side end restrict member.

12. An image forming apparatus according to claim 10, wherein each of the pair of paper side end register sections comprise a horizontally extending groove configured to hold the paper to prevent it from dropping onto the paper carrying portion.

13. The image forming apparatus according to claim 9, wherein each of the pair of paper side end register sections comprise a horizontally extending groove configured to hold the paper to prevent it from dropping onto the paper carrying portion.

14. An image forming apparatus, comprising:

a discharge member that discharges paper;

a paper carry portion that carries thereon paper discharge by the discharge member;

a first moving section that moves the discharge member in a paper width direction to shift a paper carry position at which the paper is carried onto the paper carry portion between a first paper carry position and a second paper carry position;

a pair of paper side end register sections that holds the paper carried onto the paper carry portion from both sides of the paper in the paper width direction to register positions of side ends of the paper;

a second moving section that moves the pair of paper side end register sections in the paper width direction; and a discharge paper control section that, when the shifting direction of the paper by the first moving section is switched from one direction to another direction of the paper width direction, controls the second moving section to move the pair of paper side end register sections in said another direction of the paper width direction, wherein each of the pair of paper side end register sections includes a side end restrict member that restricts the side end position of the paper to be carried onto the first or second paper carry portion, the paper discharge control section controls the discharge member and the first moving section to discharge and carry a given number of sheets of paper at a first paper carry position on the paper carry portion, the paper discharge control section controls the discharging member and the first moving section to discharge a given number of sheets of paper at a second paper carry position on the given number of sheets of paper carried at the first paper carry position, a center axis is defined as a reference for the first and second paper carry positions in the paper width direction, and during a period in which the discharge member is discharging the given number of sheets of paper to the second paper carry position, the paper discharging control section controls one of the side end restrict members located nearer to the center axis than the other to be in contact with the upper-most surface of paper of the given number of sheets of paper carried at the first paper carry position.

15. An image forming apparatus according to claim 14, wherein each of the pair of paper side end register sections comprise a horizontally extending groove configured to hold the paper to prevent it from dropping onto the paper carrying portion.

* * * * *